US009272808B2

(12) United States Patent
Glinert

(10) Patent No.: US 9,272,808 B2
(45) Date of Patent: Mar. 1, 2016

(54) PACKAGING AND INTEGRATED UTILITY ITEM

(71) Applicant: Multi Packaging Solutions, Inc., Lansing, MI (US)

(72) Inventor: Kenneth Glinert, Chappaqua, NY (US)

(73) Assignee: Multi Packaging Solutions, Inc., Lansing, MI (US)

( * ) Notice: Subject to any disclaimer, the term of this patent is extended or adjusted under 35 U.S.C. 154(b) by 99 days.

(21) Appl. No.: 13/785,201

(22) Filed: Mar. 5, 2013

(65) Prior Publication Data

US 2013/0240612 A1 Sep. 19, 2013

Related U.S. Application Data

(60) Provisional application No. 61/610,223, filed on Mar. 13, 2012.

(51) Int. Cl.

| | |
|---|---|
| ***B65D 27/26*** | (2006.01) |
| ***B65D 5/42*** | (2006.01) |
| ***B65D 51/00*** | (2006.01) |
| ***B65D 5/20*** | (2006.01) |

(52) U.S. Cl.

CPC ..... *B65D 5/42* (2013.01); *B65D 5/2066* (2013.01); *B65D 5/4233* (2013.01); *B65D 51/00* (2013.01); *B65D 2313/00* (2013.01); *B65D 2313/04* (2013.01); *Y10T 29/4973* (2015.01)

(58) Field of Classification Search

CPC ..... Y02W 30/807

USPC ..... 229/78.2, 79, 80, 77, 76, 80.5, 78.1, 229/92.5

See application file for complete search history.

(56) References Cited

U.S. PATENT DOCUMENTS

| | | | | |
|---|---|---|---|---|
| 1,456,036 | A * | 5/1923 | Nissen | 229/78.2 |
| 3,749,301 | A * | 7/1973 | Peckar | 229/125.37 |
| 4,638,912 | A * | 1/1987 | Graf | 229/247 |
| 4,738,390 | A * | 4/1988 | Brennan | 229/77 |
| 4,982,845 | A * | 1/1991 | Prascak et al. | 229/87.05 |
| 5,217,307 | A * | 6/1993 | McClintock | 383/81 |
| 6,048,100 | A * | 4/2000 | Thrall et al. | 383/86 |
| 6,223,400 | B1 * | 5/2001 | Lenack | 229/125.39 |
| 6,338,572 | B1 * | 1/2002 | Schneck | 383/205 |
| 6,691,913 | B1 * | 2/2004 | Rodriguez | 229/246 |
| 8,662,086 | B2 * | 3/2014 | Kesselman | 131/105 |
| 2006/0151340 | A1 | 7/2006 | Meister | |

(Continued)

FOREIGN PATENT DOCUMENTS

| | | |
|---|---|---|
| DE | 102004048541 | 4/2006 |
| GB | 1100677 | 1/1968 |
| WO | 2013/138141 | 9/2013 |

OTHER PUBLICATIONS

PCT International Preliminary Report on Patentability dated Sep. 25, 2014; application No. PCT/US2013/029478.

(Continued)

*Primary Examiner* — Jes F Pascua
*Assistant Examiner* — Derek Battisti
(74) *Attorney, Agent, or Firm* — The Dobrusin Law Firm, PC

(57) ABSTRACT

A foldable packaging which may include a die-cut form that is initially substantially planar and foldable to provide a container that can be assembled having a fastening mechanism that is removable for additional uses.

10 Claims, 2 Drawing Sheets

(56) References Cited

U.S. PATENT DOCUMENTS

| | | | | |
|---|---|---|---|---|
| 2010/0276313 | A1* | 11/2010 | Nakano et al. | 206/268 |
| 2012/0080509 | A1* | 4/2012 | Bettinger | 229/78.2 |
| 2013/0119121 | A1* | 5/2013 | Cenzano | B65D 27/14 229/79 |
| 2013/0193195 | A1* | 8/2013 | Cenzano | B65D 27/14 229/80.5 |

OTHER PUBLICATIONS

International Search Report & Written Opinion dated Jun. 14, 2013; application No. PCT/US2013/029478.

European Communication dated Oct. 13, 2015; Application No. 13711786.7.

* cited by examiner

PACKAGING AND INTEGRATED UTILITY ITEM

FIELD OF THE INVENTION

The present teachings relate generally to foldable packaging, and more specifically to a die-cut form that is initially substantially planar and foldable to provide a container that can be assembled having a fastening mechanism that is removable for additional uses.

BACKGROUND OF THE INVENTION

There exists a need for product packaging which allows for goods within the packaging to be repeatedly located into and out of the packaging, without destroying the packaging and also includes a fastening device that is removable and has a secondary use beyond its use as a fastening device for the packaging.

SUMMARY OF THE INVENTION

The present teachings meet some or all of the above needs by providing a packaging comprising an envelope portion and a cover portion. The envelope portion may include a plurality of adjacent walls including a back wall, a front wall and three side walls, the back wall and front wall each being connected to each of the side walls and also a first fastening device located onto the front wall. The cover portion may be located adjacent and attached to the envelope portion, the cover portion including a second removable fastening device. Upon locating the cover portion in an overlying relationship with the envelope portion, the first fastening device and second fastening device facilitate closure of the packaging whereby the cover portion remains in overlying relationship with the envelope portion until the first and second fastening device are disengaged from one another. The second fastening device may also be positioned for removal from the cover portion.

The second fastening device may be contacted with a strip including an adhesive so that that the second fastening device remains located on the cover portion until the strip is removed. The first and second fastening device may be magnetic. The front wall of the envelope portion may include a top side and a bottom side and the first fastening device may fee located onto the bottom side of the front wall. The cover portion may include a top side and a bottom side and the second fastening device may be located on the back side of the cover portion. The second fastening device may also be a ball marker. The second fastening device may be used for an additional non-fastening use and then replaced onto the cover portion for continued use as a fastening device. At least one side wall may have a length that is at least twice the length of an adjacent side wall. The first fastening device may be located within the envelope portion and thus not visible from the exterior of the packaging.

The present teachings further provide for a method of using the packaging described herein comprising disconnecting the first fastening device from the second fastening device, removing the second fastening device from an opening for receiving the second fastening device located in the cover portion of the packaging, replacing the second fastening device info the opening for receiving the second fastening device and re-connecting the first fastening device and second fastening device. The method may include utilizing the second fastening device for an additional non-fastening purpose prior to replacing the second fastening device into the opening for receiving the second fastening device. The method may include utilizing the second fastening device as a golf ball marker prior to replacing the second fastening device into the opening for receiving the second fastening device. The method may include removing an item from within the packaging after disconnecting the first fastening device from the second fastening device. The method may include locating the cover portion in an overlying relationship with the envelope portion whereby the cover portion remains in overlying relationship with the envelope portion until the first and second fastening device are disconnected from one another.

The teachings herein further contemplate a closure device comprising a first panel including a first fastening device, a second panel located adjacent the first panel, an opening for receiving a second fastening device formed within the second panel and a second fastening device removably located into the opening for receiving the second fastening device. The first panel may be adapted for folding over the second panel so that the first fastening device and second fastening device come into direct contact with one another. The second fastening device may have an additional non-fastening use upon removal from the second panel. The second fastening device may be removed from the second panel and then replaced onto the second panel for continued use as a fastening device. One or more of the first and second fastening devices may be magnetic. One or more of the first and second fastening devices may be metallic. The second panel may include a top side and a bottom side and the second fastening device is located on the bottom side of the second panel.

The packaging herein offers any of a number of benefits and advantages, including but not limited to one or any combination of the following: the packaging may be opened and closed and the contents of the packaged removed and replaced without destroying the packaging. A portion of the fastening device may be removable and may be utilized for additional non-fastening uses.

DETAILED DESCRIPTION

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

This application is related to and claims the benefit of the priority date of U.S. Provisional Application Ser. No. 61/810, 223, filed on Mar. 13, 2012. The entirety of that application is hereby incorporated by reference for all purposes.

The packaging described herein is designed to include a closure device that (i) closes the packaging; (ii) is removably connected to the packaging such that at least a portion of the closure device is easily removed and re-attached to the packaging; and (iii) facilitates frequent opening and closing of the packaging. The packaging may further be adapted so that at least a portion of the closure device has some other utility, so that the closure device can be removed from the packaging, utilized for some other non-fastening related purpose, and then re-attached to the packaging. In one non-limiting example, the packaging may be formed to hold golf gloves, or another golf-related accessory. A portion of the fastening device may also function as a ball marker that may be removed from the packaging to be utilized as such and the re-attached to the packaging for storage when no longer needed. Another example would be a packaging for holding wine or a wine-related accessory, wherein a portion of the fastening device may function as a foil cutter, a corkscrew, or another wine-related accessory.

The packaging may also be a single-use packaging, such that closure may include an item that may or may not be re-attached to the packaging. As a non-limiting example, the packaging may be formed for receiving perfume and/or cosmetics and the closure may be a bonus gift such as a keychain, a pendant or the like.

Figure 1:
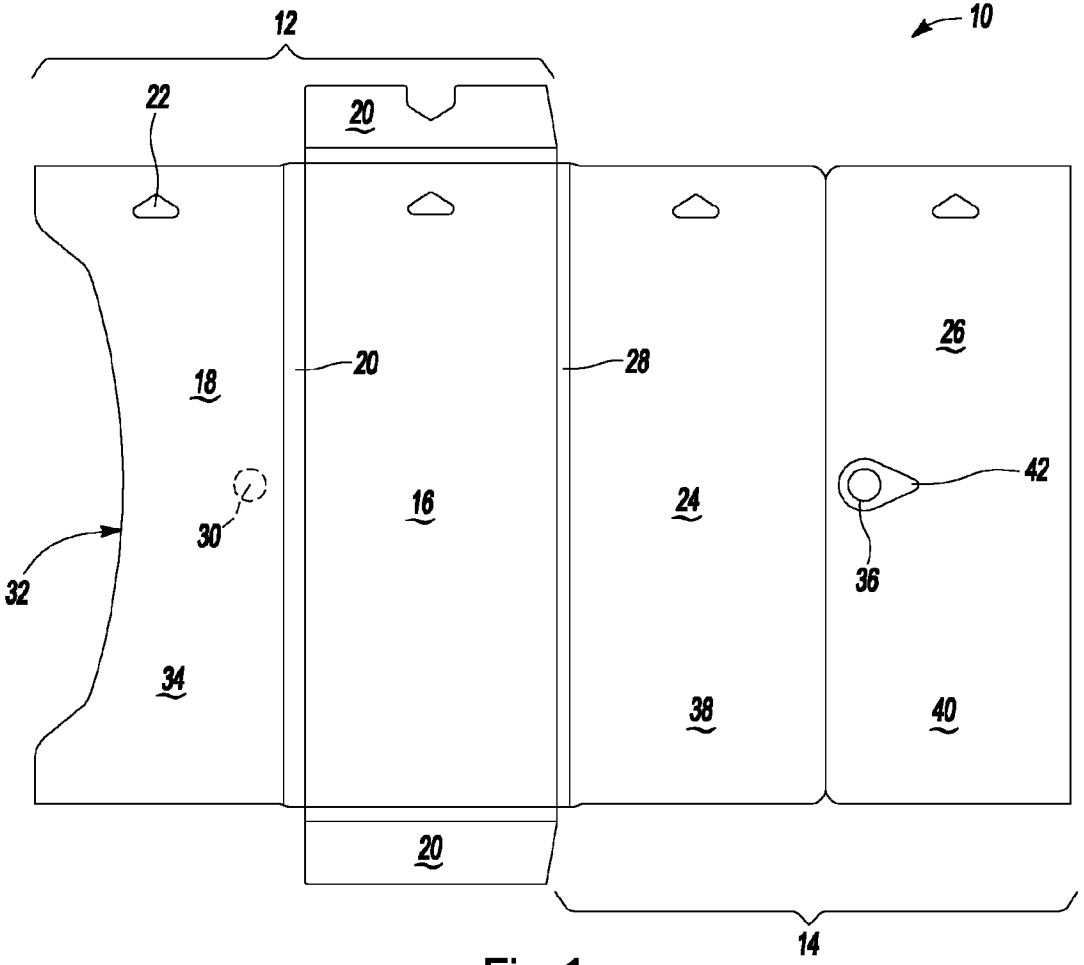
FIG. 1 is a top-down view of a die-cut pattern for forming an illustrative example of the packaging of the present teachings.

As shown for example in FIG. 1, the packaging 10 includes an envelope portion 12 (e.g., a first panel) and a cover portion 14 (e.g., a second panel). The envelope portion includes a back wall 18, a front wall 18 and three side walls 20. One or more of the walls may include an opening 22. The front wall 18 may only partially cover the back wall as shown, so that products located within the packaging can be easily viewed and removed. The cover portion 14 may include a front wall 24 and a back wall 28 and may be attached to the envelope portion by a side wall 28 located therebetween.

A first fastening device 30 may be located onto the envelope portion (e.g., the first panel). It may be located onto the front wall or back wall of the envelope portion. As shown, the front wall of the envelope portion includes a top side 32 and a bottom side 34, the first fastening device 30 being located onto the bottom side 34 of the front wall 18.

A second fastening device 38 may be located onto the cover portion (e.g., the second panel) 14. The cover portion includes a top side 38 and a bottom side 40 and the second fastening device 38 may be located onto the bottom side 40 of the cover portion.

Figure 2:
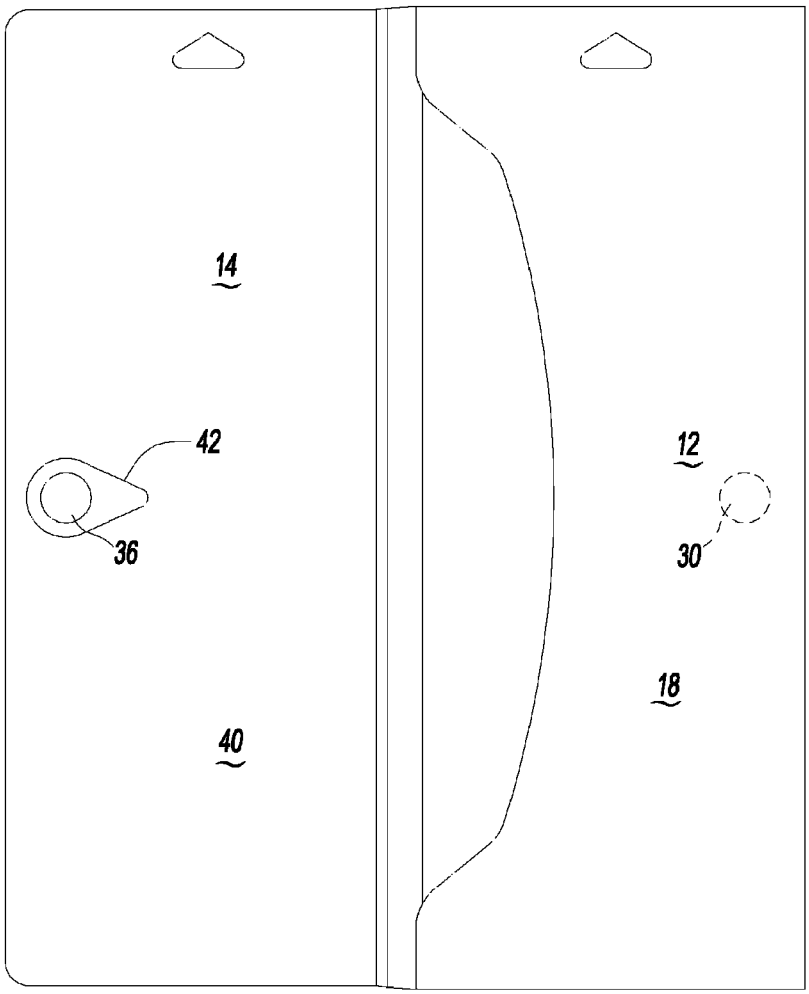
FIG. 2 is a perspective view of the packaging of FIG. 1 shown in folded format.

FIG. 2 depicts the packaging in a folded and opened form, showing the envelope portion (e.g., the first panel) 12 and cover portion (e.g., the second panel) 14. The second fastening device 38 is visible and located onto the bottom side 40 of the cover portion 14. The second fastening device is shown having an adhesive strip 42 covering the second fastening device 36, so that the adhesive strip 42 can be displaced from covering the second fastening device and the second fastening device can thereafter be removed from the packaging. The first fastening device is not visible, but is located onto the bottom side of the front wall 18 of the envelope portion 12. However, the magnetic nature of both the first and second fastening device allow for closure of the packaging without direct contact, despite the presence of any panel, portion, or adhesive strip in between.

The fastening device may not be limited to magnets but may include mechanical fasteners, clips, tabs, press-fits, snap-fits, screws, hooks, combinations thereof or the like. The fastener may be provided as a magnetic material or an adhesive material that can attach (e.g., adhere or magnetically secure), disengage and re-attach as needed.

The packaging may be formed in a standard shape, but produced in a number of varying sizes. For example, the packaging may be formed to fit an item as small as a gift card, or alternatively, as large as a wine bottle, a potted plant, or even larger. The packaging may be folded to form a shape other than a standard six-sided box. The packaging may be folded to form a triangular or circular package. The packaging may form a pouch or envelope.

Prior to folding, the packaging may be a flat sheet material (e.g., a paperboard form) that is die cut and scored to obtain the necessary shape and to impart scored fold lines. In its folded format, the packaging may include an exterior surface, and an interior surface.

The packaging substrate for forming the packaging may be any material pliable enough to be scored and folded but strong enough to withstand the weight of a contained item. The substrate may be formed of paper materials including but not limited to paperboard, chipboard, cardboard, fiberboard, natural fibers, mineral fibers or any combination thereof. The material may be a virgin material, a post-consumer recycled material, or both. The substrate material may be a recyclable material and/or a biodegradable material. If the substrate material includes paperboard, the paperboard may be a bleached or unbleached paperboard. For example it may be a solid bleached sulfate (SBS) paperboard. The material may contain a major portion that can be recycled. The base substrate material may be formed of a polymeric material including but not limited to thermoplastics, thermoset plastics, elastomeric containing materials or any combination thereof. Examples of polymeric materials that may be employed include polyamide, polyester, polystyrene, polyethylene (including polyethylene terephthlate, high density polyethylene and low density polyethylene), polypropylene, polyvinyl chloride, bio-based plastics/biopolymers (e.g., poly lactic acid), silicone, acrylonitrile butadiene styrene (ABS), or any combination thereof.

The gauge of the substrate material may vary depending on the size of the packaging of the desired strength of the packaging. As an example, if the substrate material includes paperboard, the gauge of the paperboard may be greater than about 10 point paperboard. The gauge of the paperboard may be less than about 22 point paperboard.

The packaging may also include designs or coverings to add a decorative element to the packaging. The packaging may be covered with a decorative coating that is extruded or printed onto the exterior of the packaging, the interior of the packaging, or both. The adhesive strip may include a design or logo, as might one or both of the fastening devices. As an example, the packaging material may be covered in a metallic coating (e.g., a metalized polyethylene and/or polyester coating). The packaging may include a foil covering. The packaging may also include a coating for projecting a holographic-type image or pattern. Any coating or other design element may be attached to any surface of the packaging via an adhesive. Any coating or other design element may be ink jet or laser printed directly onto any surface of the packaging. Any surface of the packaging may be embossed, printed, silkscreened, or engraved with a design element. Any design element or coating may be customizable.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 4.3 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

What is claimed is:

1. A packaging comprising:

an envelope portion having:

i. a plurality of adjacent walls including a back wall and a front wall;

ii. a first fastening device located onto the front wall;

a cover portion located adjacent and attached to the envelope portion, the cover portion including a second removable fastening device; and wherein upon locating the cover portion in an overlying relationship with the envelope portion, the first fastening device and second fastening device facilitate closure of the packaging;

wherein the first and second fastening device are magnetic; and wherein the second fastening device is removably affixed for removal from and re-attachment to the cover portion and is used for an additional non-fastening use and then replaced onto the cover portion for continued use as a fastening device.

2. The packaging of claim 1, wherein the second fastening device is contacted with a strip including an adhesive so that that the second fastening device remains located on the cover portion until the strip is removed.

3. The packaging of claim 1, wherein the front wall of the envelope portion includes a top side and a bottom side and the first fastening device is located onto the bottom side of the front wall.

4. The packaging of claim 1, wherein the cover portion includes a top side and a bottom side and the second fastening device is located on the bottom side of the cover portion.

5. The packaging of claim 1, wherein the second fastening device is a ball marker.

6. The packaging of claim 1, wherein the envelope portion includes three side walls and at least one side wall has a length that is at least twice the length of an adjacent side wall.

7. The packaging of claim 1, wherein the first fastening device is located within the envelope portion and thus not visible from the exterior of the packaging.

8. A closure device comprising:

a first panel including a first fastening device;

a second panel located adjacent the first panel;

an opening for receiving a second fastening device formed within the second panel;

a second fastening device removably located into the opening for receiving the second fastening device; and wherein one or more of the first and second fastening devices are magnetic;

wherein the first panel is adapted for folding over the second panel so that the first fastening device and second fastening device come into direct contact with one another; and wherein the second fastening device is removably affixed for removal from and re-attachment to the cover portion and is used for an additional non-fastening use and then replaced onto the cover portion for continued use as a fastening device.

9. The closure device of claim 8, wherein one or more of the first and second fastening devices are metallic.

10. The closure device of claim 8, wherein the second panel includes a top side and a bottom side and the second fastening device is located on the bottom side of the second panel.

* * * * *